US010283067B2

(12) United States Patent
Hao

(10) Patent No.: US 10,283,067 B2
(45) Date of Patent: May 7, 2019

(54) GOA DRIVING CIRCUIT AND LCD

(71) Applicant: Shenzhen China Star Optoelectronics Semiconductor Display Technology Co., Ltd., Shenzhen (CN)

(72) Inventor: Sikun Hao, Shenzhen (CN)

(73) Assignee: SHENZHEN CHINA STAR OPTOELECTRONICS SEMICONDUCTOR DISPLAY TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/742,036

(22) PCT Filed: Nov. 15, 2017

(86) PCT No.: PCT/CN2017/111061

§ 371 (c)(1),
(2) Date: Jan. 5, 2018

(87) PCT Pub. No.: WO2019/024324

PCT Pub. Date: Feb. 7, 2019

(65) Prior Publication Data

US 2019/0043437 A1 Feb. 7, 2019

(30) Foreign Application Priority Data

Aug. 1, 2017 (CN) ..... 2017 1 0648973

(51) Int. Cl.
*G09G 3/36* (2006.01)

(52) U.S. Cl.
CPC ..... *G09G 3/3677* (2013.01); *G09G 2310/067* (2013.01)

(58) Field of Classification Search
CPC ..... G09G 3/3614; G09G 3/3677; G09G 2300/0426; G09G 2310/0205
See application file for complete search history.

(56) References Cited

U.S. PATENT DOCUMENTS

2004/0141137 A1* 7/2004 Hirabayashi ..... G02F 1/134309 349/149
2009/0304138 A1* 12/2009 Tsai ..... G11C 19/28 377/79

(Continued)

FOREIGN PATENT DOCUMENTS

CN 102411916 A 4/2012
CN 104008741 A 8/2014

(Continued)

*Primary Examiner* — Shaheda A Abdin
(74) *Attorney, Agent, or Firm* — Leong C. Lei

(57) ABSTRACT

The invention provides a GOA driving circuit, comprising: a plurality of GOA units connected in cascade, each GOA unit comprising a pull-up control module (1), a pull-up module (2), a pull-down module (3), a first pull-down maintenance module (4), and a second pull-down maintenance module (5); on the basis of ensuring the normal function of the GOA unit, the pull-down module (3) uses one less TFT than the prior art, the first pull-down maintenance module (4) uses one less TFT than the prior art, the second pull-down maintenance module (5) uses one less TFT than the prior art, thereby saving the wiring area used by GOA driving circuit and facilitating the narrow border LCD. The invention provides an LCD using the GOA driving circuit. Therefore, the number of the TFTs of the GOA driving circuit is less, the wiring area is smaller, and the LCD border is narrower.

15 Claims, 4 Drawing Sheets

(56) References Cited

U.S. PATENT DOCUMENTS

| | | | | |
|---|---|---|---|---|
| 2012/0001878 | A1* | 1/2012 | Kurokawa | G06F 3/0412 345/204 |
| 2012/0120035 | A1* | 5/2012 | Yang | G09G 3/3614 345/205 |
| 2016/0266699 | A1* | 9/2016 | Zhao | G09G 3/3677 |
| 2016/0351156 | A1* | 12/2016 | Wu | G11C 19/28 |

FOREIGN PATENT DOCUMENTS

| | | | |
|---|---|---|---|
| CN | 104167166 | A | 11/2014 |
| CN | 104282285 | A | 1/2015 |
| KR | 101027827 | B1 | 4/2011 |

* cited by examiner

GOA DRIVING CIRCUIT AND LCD

BACKGROUND OF THE INVENTION

1. Field of the Invention

The present invention relates to the field of display techniques, and in particular to a GOA driving circuit and LCD.

2. The Related Arts

The liquid crystal display (LCD), or LCD panel, provides the advantages of thinness, power-saving, no radiation, and so on, and is widely applied to, such as, liquid crystal TV, smart phone, digital camera, tablet PC, PC monitor, or notebook PC, and stays as a leading technology in panel display.

The operation principle behind the LCD is to pour liquid crystal (LC) molecules between the thin film transistor (TFT) array substrate and the color filter (CF) substrate, and then apply a driving voltage to the two substrates to control the rotation direction of the LC molecules to refract the light of the backlight module r to produce the image.

The LCD has a plurality of pixels arranged in an array, with each pixel electrically connected to a TFT, the gate of the TFT T connected to a horizontal scan line, the source connected to the vertical data line, and the drain connected to the pixel electrode. Applying the gate scan signal Gate to the scan line 100 will cause all the TFTs T connected to the scan line 100 to turn on. Then, applying the data signal Data to the data line 200 will be able to write into corresponding sub-pixel to control the LC transmittance to achieve color and brightness control. Gate-driver-on-Array (GOA) uses the existing TFT array process to fabricate integratedly the gate scan driving circuit on the TFT array to achieve driving the gates. Replacing the conventional gate driver IC with GOA has the potential to improve yield rate and reduce cost, as well as making the LCD more suitable for narrow-border or borderless display products.

FIG. 1 shows a known GOA driving circuit, comprising: a plurality of cascade GOA units, each GOA unit comprising a pull-up control module 100, a pull-up module 200, a pull-down module 300, a first pull-down maintenance module 400, a second pull-down maintenance module 500, and a bootstrap capacitor 600, electrically connected to a first node Q(n) and a second node P(n).

For an integer n, in n-th GOA unit, the pull-up module 200 is mainly responsible for outputting the x-th high-frequency clock signal C (x) in the inputted high-frequency clock signal set to the corresponding scanning line as the scan driving signal G(n), while outputting the cascade-propagate signal ST(n).

The pull-up control module 100 is connected to receive the scan driving signal G(n−6) and the cascade-propagate signal ST(n−6) outputted from the (n−6)th GOA unit to control the turn-on of the pull-up module 200.

The pull-down module 300 comprises two TFTs T31 and T41, wherein: T31 is connected to the scan driving signal G(n+6) outputted from the (n+6)th GOA unit and the DC low voltage VSS, and is responsible for quickly pulling the scan driving signal G(n) and the second node P(n) down to low voltage after the scanning driving signal G(n) outputting high voltage; T41 is connected to the scan driving signal G(n+6) outputted from the (n+6)th GOA unit and the DC low voltage VSS, is responsible for quickly pulling the first node Q (n) to low voltage after the scan driving signal G(n) outputting a high voltage, turning off the pull-up module 200.

The first pull-down maintenance module 400 is connected to the first low-frequency clock signal LC1 and the DC low-voltage VSS, and the second pull-down maintenance module 500 is connected to the second low-frequency clock signal LC2 and the DC low-voltage VSS, and the two operate alternatingly so that the first node Q(n) and the second node P(n) are kept at a low voltage; wherein the first pull-down maintenance module 400 comprises six TFTs: T51, T52, T53, T54, T32, and T42, and the second pull-down maintenance module 500 comprises six TFTs: T61, T62, T63, T64, T33, and T43.

The shortcomings of the existing GOA driving circuit are that the number of TFTs is large and requires a larger wiring area, disadvantageous to the narrow border trend of LCD.

SUMMARY OF THE INVENTION

The object of the present invention is to provide a GOA driving circuit, able to reduce the number of TFTs and save GOA wiring area to enable border narrowing of LCD.

Another object of the present invention is to provide an LCD with a GOA driving circuit, able to reduce the number of TFTs and save GOA wiring area to enable border narrowing of LCD.

To achieve the above object, the present invention provides a GOA driving circuit, which comprises: a plurality of cascade GOA units, with each GOA unit comprising a pull-up control module, a pull-up module, a pull-down module, a first pull-down maintenance module, and a second pull-down maintenance module;

for integers n and x, in the n-th GOA unit:

the pull-up control module being electrically connected to a first node, for controlling the pull-up module to turn on;

the pull-up module being electrically connected to the first node and a second node, for receiving a x-th high-frequency clock signal in a high-frequency clock signal set, and outputting high voltage of the x-th high-frequency clock signal to corresponding scan line as a scan driving signal, outputting a cascade-propagate signal, and pulling down voltage levels of the scan driving signal and the second node after the scan driving signal outputting high voltage;

the pull-down module only comprising a $41^{st}$ thin film transistor (TFT), the $41^{st}$ TFT having a source electrically connected to the first node, a drain connected to a direct current (DC) low voltage, for pulling down voltage level of the first node after the scan driving signal outputting;

the first pull-down maintenance module comprising: a $51^{st}$ TFT, a $52^{nd}$ TFT, a $53^{rd}$ TFT, a $32^{nd}$ TFT, and a $42^{nd}$ TFT; the $51^{st}$ TFT having a gate and a source receiving a first low-frequency clock signal, and a drain electrically connected to a third node; the $53^{rd}$ TFT having a gate electrically connected to the third node, a source receiving the first low-frequency clock signal, and a drain electrically connected to the third node; the $52^{nd}$ TFT having a gate electrically connected to the first node, a source connected to the third node, and a drain receiving a DC low voltage; the $32^{nd}$ TFT having a gate electrically connected to the third node, a source electrically connected to the second node, and a drain receiving DC low voltage; the $42^{nd}$ TFT having a gate electrically connected to the third node, a source electrically connected to the first node, and a drain receiving the DC low voltage;

the second pull-down maintenance module comprising: a $61^{st}$ TFT, a $62^{nd}$ TFT, a $63^{rd}$ TFT, a $33^{rd}$ TFT, and a $43^{rd}$ TFT;

the $61^{st}$ TFT having a gate and a source receiving a second low-frequency clock signal, and a drain electrically connected to a fourth node; the $63^{rd}$ TFT having a gate electrically connected to the fourth node, a source receiving the second low-frequency clock signal, and a drain electrically connected to the fourth node; the $62^{nd}$ TFT having a gate electrically connected to the first node, a source connected to the fourth node, and a drain receiving a DC low voltage; the $33^{rd}$ TFT having a gate electrically connected to the fourth node, a source electrically connected to the second node, and a drain receiving DC low voltage; the $43^{rd}$ TFT having a gate electrically connected to the fourth node, a source electrically connected to the first node, and a drain receiving the DC low voltage;

the first pull-down maintenance module and the second pull-down maintenance module operating alternatingly to maintain the voltage level of the scan driving signal, the second node, and the first node at low voltage after pulled down.

According to a preferred embodiment of the present invention, the GOA driving circuit further comprises a bootstrap capacitor, with two electrode plates electrically connected to the first node and the second node respectively.

According to a preferred embodiment of the present invention, the pull-up control module comprises an $11^{th}$ TFT;

assuming m is an integer less than n, except the first GOA unit to the m-th GOA unit, in the n-th GOA unit, the $11^{th}$ TFT has a gate receiving a cascade-propagate signal outputted from (n−m)th GOA unit, a source receiving a scan driving signal outputted from (n−m)th GOA unit, and a drain electrically connected to the first node;

except the last GOA unit to the last m-th GOA unit, in the n-th GOA unit, the $41^{st}$ TFT has a gate receiving a cascade-propagate signal outputted from (n+m)th GOA unit.

According to a preferred embodiment of the present invention, the pull-up module comprises a $21^{st}$ TFT and a $22^{nd}$ TFT;

the $21^{st}$ TFT has a gate electrically connected to the first node, a source receiving an x-th high-frequency clock signal in a high-frequency clock signal set, and a drain electrically connected to the second node and outputting the scan driving signal of the n-th GOA unit;

the $22^{nd}$ TFT has a gate electrically connected to the first node, a source receiving an x-th high-frequency clock signal in a high-frequency clock signal set, and a drain outputting the cascade-propagate signal of the n-th GOA unit.

According to a preferred embodiment of the present invention, in the first GOA unit to the m-th GOA unit, the 11th TFT has a gate receiving an STV signal and a source receiving the STV signal;

in the last GOA unit to the last m-th GOA unit, the $41^{st}$ TFT has a gate receiving the STV signal.

According to a preferred embodiment of the present invention, m is set to 6.

According to a preferred embodiment of the present invention, the first low-frequency clock signal and the second low-frequency clocks signal have opposite phase.

According to a preferred embodiment of the present invention, the high-frequency clock signal set comprises 12 high-frequency clock signals; with every 12 GOA units as a repetition unit, the 12 GOA units of a repetition unit receive the first to $12^{th}$ high-frequency clock signal sequentially.

According to a preferred embodiment of the present invention, the STV signal has a rising edge generated prior to the rising edge of the first high-frequency clock signal, and the STV signal has a falling edge generated simultaneously with falling edge of the first high-frequency clock signal.

The present invention also provides an LCD, which comprises the aforementioned GOA driving circuit.

The present invention also provides a GOA driving circuit, which comprises: a plurality of cascade GOA units, with each GOA unit comprising a pull-up control module, a pull-up module, a pull-down module, a first pull-down maintenance module, and a second pull-down maintenance module;

for integers n and x, in the n-th GOA unit:

the pull-up control module being electrically connected to a first node, for controlling the pull-up module to turn on;

the pull-up module being electrically connected to the first node and a second node, for receiving a x-th high-frequency clock signal in a high-frequency clock signal set, and outputting high voltage of the x-th high-frequency clock signal to corresponding scan line as a scan driving signal, outputting a cascade-propagate signal, and pulling down voltage levels of the scan driving signal and the second node after the scan driving signal outputting high voltage;

the pull-down module only comprising a $41^{st}$ thin film transistor (TFT), the $41^{st}$ TFT having a source electrically connected to the first node, a drain connected to a direct current (DC) low voltage, for pulling down voltage level of the first node after the scan driving signal outputting;

the first pull-down maintenance module comprising: a $51^{st}$ TFT, a $52^{nd}$ TFT, a $53^{rd}$ TFT, a $32^{nd}$ TFT, and a $42^{nd}$ TFT; the $51^{st}$ TFT having a gate and a source receiving a first low-frequency clock signal, and a drain electrically connected to a third node; the $53^{rd}$ TFT having a gate electrically connected to the third node, a source receiving the first low-frequency clock signal, and a drain electrically connected to the third node; the $52^{nd}$ TFT having a gate electrically connected to the first node, a source connected to the third node, and a drain receiving a DC low voltage; the $32^{nd}$ TFT having a gate electrically connected to the third node, a source electrically connected to the second node, and a drain receiving DC low voltage; the $42^{nd}$ TFT having a gate electrically connected to the third node, a source electrically connected to the first node, and a drain receiving the DC low voltage;

the second pull-down maintenance module comprising: a $61^{st}$ TFT, a $62^{nd}$ TFT, a $63^{rd}$ TFT, a $33^{rd}$ TFT, and a $43^{rd}$ TFT; the $61^{st}$ TFT having a gate and a source receiving a second low-frequency clock signal, and a drain electrically connected to a fourth node; the $63^{rd}$ TFT having a gate electrically connected to the fourth node, a source receiving the second low-frequency clock signal, and a drain electrically connected to the fourth node; the $62^{nd}$ TFT having a gate electrically connected to the first node, a source connected to the fourth node, and a drain receiving a DC low voltage; the $33^{rd}$ TFT having a gate electrically connected to the fourth node, a source electrically connected to the second node, and a drain receiving DC low voltage; the $43^{rd}$ TFT having a gate electrically connected to the fourth node, a source electrically connected to the first node, and a drain receiving the DC low voltage;

the first pull-down maintenance module and the second pull-down maintenance module operating alternatingly to maintain the voltage level of the scan driving signal, the second node, and the first node at low voltage after pulled down;

further comprising a bootstrap capacitor, with two electrode plates electrically connected to the first node and the second node respectively;

wherein the pull-up control module comprising an $11^{th}$ TFT;

assuming m is an integer less than n, except the first GOA unit to the m-th GOA unit, in the n-th GOA unit, the $11^{th}$ TFT having a gate receiving a cascade-propagate signal outputted from (n−m)th GOA unit, a source receiving a scan driving signal outputted from (n−m)th GOA unit, and a drain electrically connected to the first node;

except the last GOA unit to the last m-th GOA unit, in the n-th GOA unit, the $41^{st}$ TFT having a gate receiving a cascade-propagate signal outputted from (n+m)th GOA unit;

wherein the pull-up module comprising a $21^{st}$ TFT and a $22^{nd}$ TFT;

the $21^{st}$ TFT having a gate electrically connected to the first node, a source receiving an x-th high-frequency clock signal in a high-frequency clock signal set, and a drain electrically connected to the second node and outputting the scan driving signal of the n-th GOA unit;

the $22^{nd}$ TFT having a gate electrically connected to the first node, a source receiving an x-th high-frequency clock signal in a high-frequency clock signal set, and a drain outputting the cascade-propagate signal of the n-th GOA unit;

wherein in the first GOA unit to the m-th GOA unit, the 11th TFT having a gate receiving an STV signal and a source receiving the STV signal;

in the last GOA unit to the last m-th GOA unit, the $41^{st}$ TFT having a gate receiving the STV signal.

The present invention provides the following advantages: the invention provides a GOA driving circuit, comprising: a plurality of GOA units connected in cascade, each GOA unit comprising a pull-up control module, a pull-up module, a pull-down module, a first pull-down maintenance module, and a second pull-down maintenance module; on the basis of ensuring the normal function of the GOA unit, the pull-down module uses one less TFT than the prior art, the first pull-down maintenance module uses one less TFT than the prior art, the second pull-down maintenance module uses one less TFT than the prior art, thereby saving the wiring area used by GOA driving circuit and facilitating the narrow border LCD. The invention provides an LCD using the GOA driving circuit. Therefore, the number of the TFTs of the GOA driving circuit is less, the wiring area is smaller, and the LCD border is narrower.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort. In the drawings.

DETAILED DESCRIPTION OF THE PREFERRED EMBODIMENTS

Figure 2:
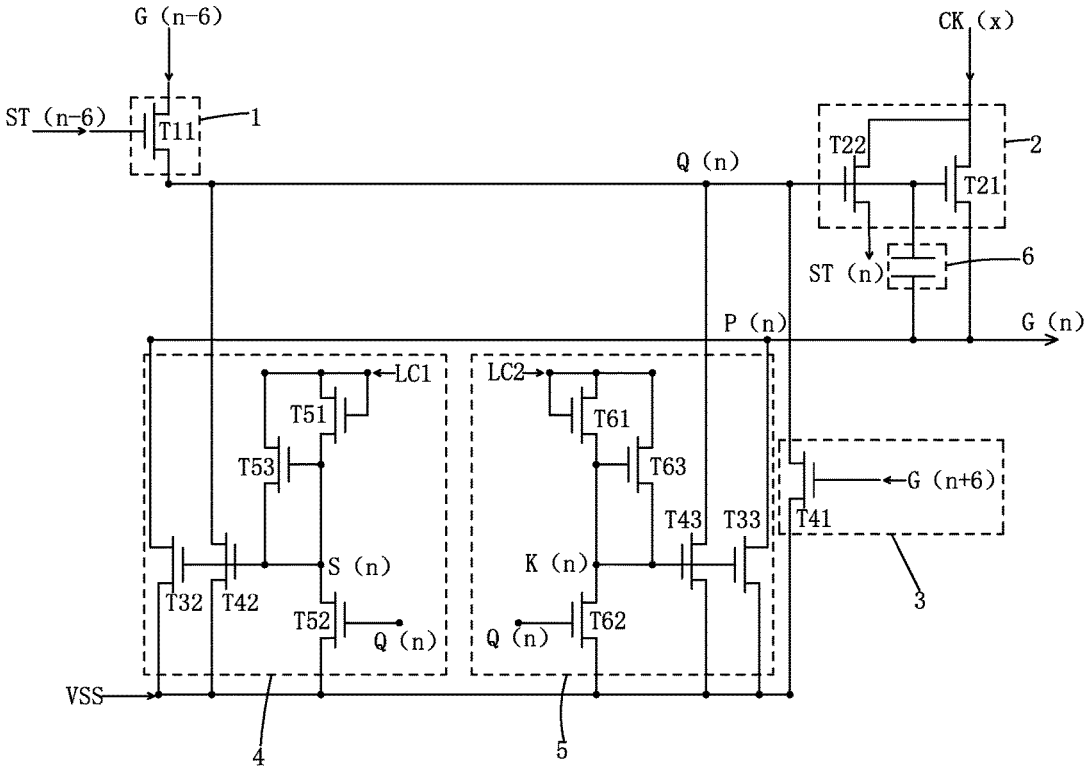
FIG. 2 is a schematic view showing a circuit of the n-th GOA unit of the GOA driving circuit of the present invention.
Figure 3:
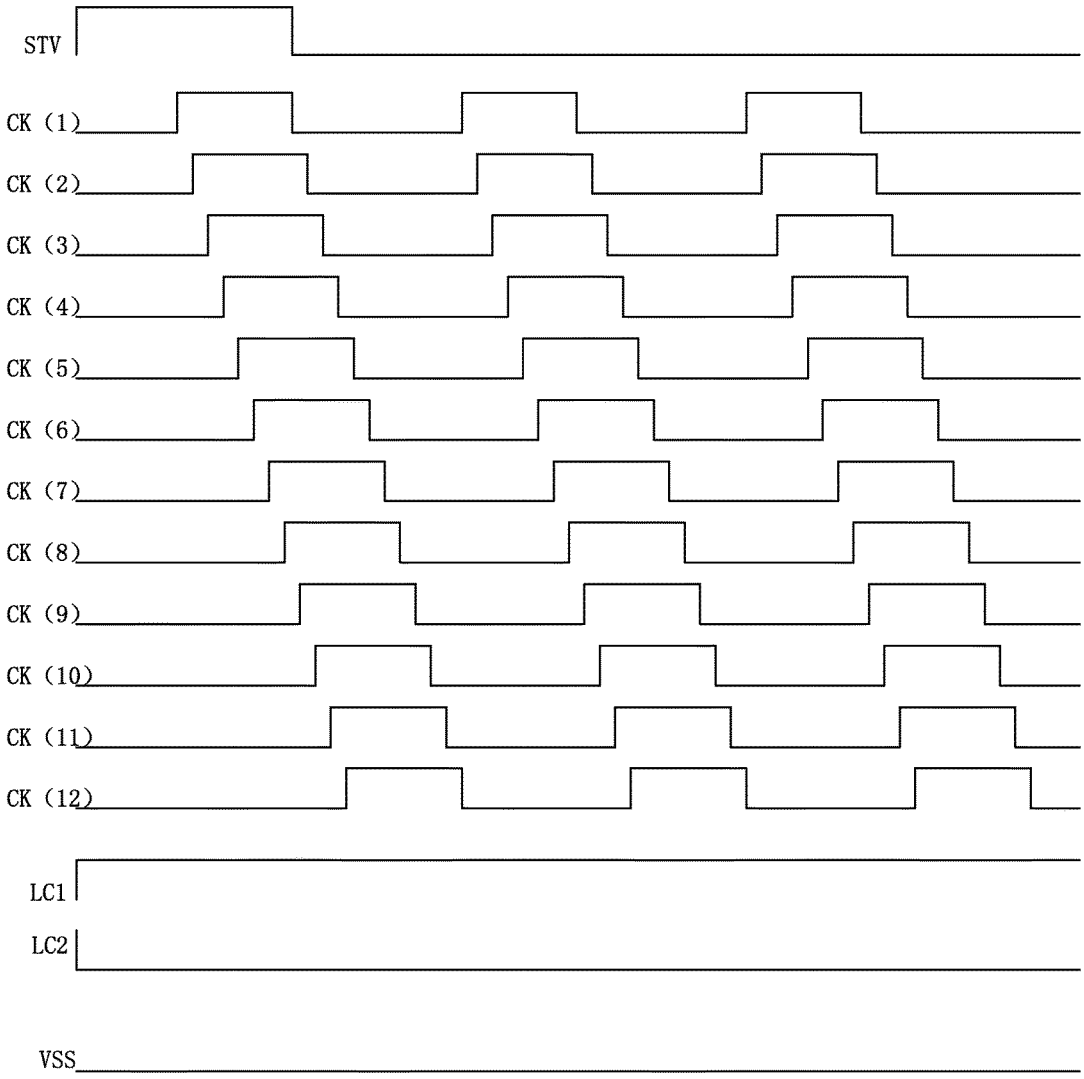
FIG. 3 is a schematic view showing the timing sequence of each driving signal of the GOA driving circuit of the present invention.
Figure 4:
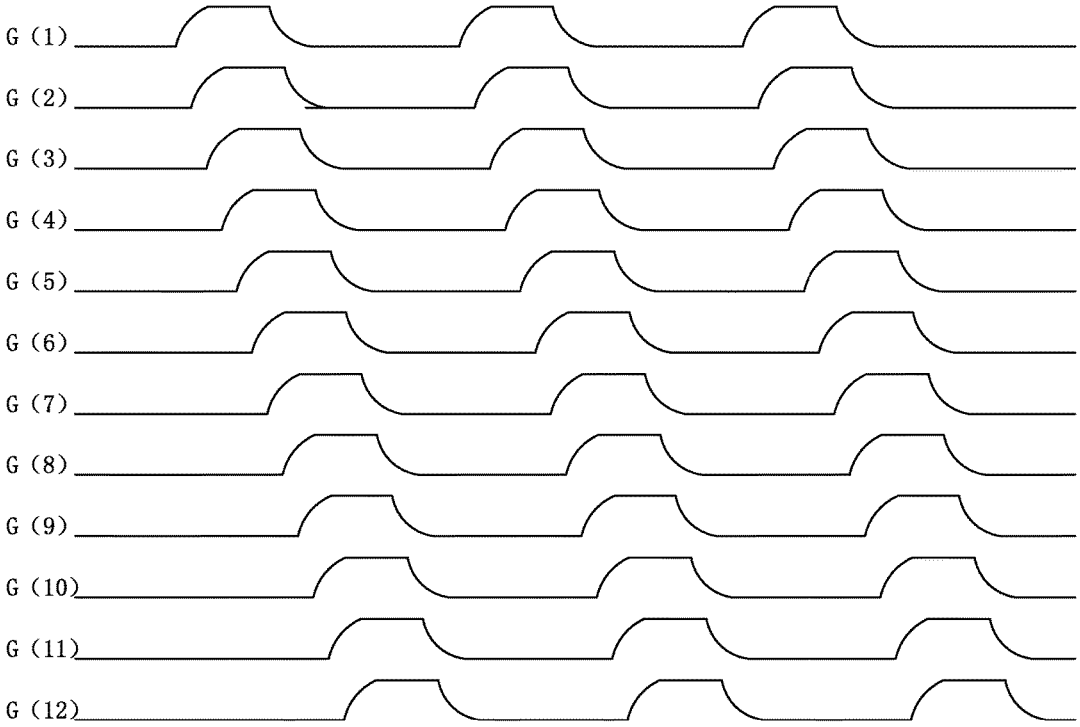
FIG. 4 is a schematic view showing the timing sequence of each scan driving signal outputted by the GOA driving circuit of the present invention.

Referring to FIG. 2, FIG. 3 and FIG. 4 simultaneously, the present invention provides a GOA driving circuit, comprising: a plurality of cascade GOA units, with each GOA unit comprising a pull-up control module 1, a pull-up module 2, a pull-down module 3, a first pull-down maintenance module 4, a second pull-down maintenance module 5, and a bootstrap capacitor 6.

The pull-up control module 1 is for controlling the pull-up module 2 to turn on. Specifically, the pull-up control module 1 comprises an $11^{th}$ TFT T11. For an integer m, m<n, except the first GOA unit to the m-th GOA unit, in the n-th GOA unit, the $11^{th}$ TFT T11 has a gate receiving a cascade-propagate signal ST(n−m) outputted from (n−m)th GOA unit, a source receiving a scan driving signal G(n−m) outputted from (n−m)th GOA unit, and a drain electrically connected to the first node Q(n); in the first GOA unit to the m-th GOA unit, the $11^{th}$ TFT has a gate receiving a synchronous activation signal, usually referred to as an STV signal, of a frame of image, and a source receiving the STV signal. Take m=6 as an example. In the $1^{st}$ to $6^{th}$ GOA units, the $11^{th}$ TFT T11 has a gate receiving an STV signal and a source receiving the STV signal. In the $7^{th}$ to last GOA units, the $11^{th}$ TFT T11 has a gate receiving a cascade-propagate signal ST(n−6) outputted from (n−6)th GOA unit, a source receiving a scan driving signal G(n−6) outputted from (n−6)th GOA unit.

The pull-up module 2 is electrically connected to the first node Q(n) and a second node P(n), for receiving a x-th high-frequency clock signal CK(x) in a high-frequency clock signal set, x being an integer, and outputting high voltage of the x-th high-frequency clock signal CK(x) to corresponding scan line as a scan driving signal G(n), outputting a cascade-propagate signal ST(n), and pulling down voltage levels of the scan driving signal G(n) and the second node P(n) after the scan driving signal G(n) outputting high voltage. Specifically, the pull-up module 2 comprises a $21^{st}$ TFT T21 and a $22^{nd}$ TFT T22. The $21^{st}$ TFT T21 has a gate electrically connected to the first node Q(n), a source receiving an x-th high-frequency clock signal CK(x) in a high-frequency clock signal set, and a drain electrically connected to the second node P(n) and outputting the scan driving signal G(n) of the n-th GOA unit. When the x-th high-frequency clock signal CK(x) is at high voltage, the scan driving signal G(n) outputted from the $21^{st}$ TFT T21 is also at high voltage; when the x-th high-frequency clock signal CK(x) changes to the low voltage, the scan driving signal G(n) outputted from the $21^{st}$ TFT T21 follows the CK(x), i.e., is pulled down to low voltage. The $22^{nd}$ TFT T22 has a gate electrically connected to the first node Q(n), a source receiving an x-th high-frequency clock signal CK(x) in a high-frequency clock signal set, and a drain outputting the cascade-propagate ST(n) of the n-th GOA unit.

Figure 1:
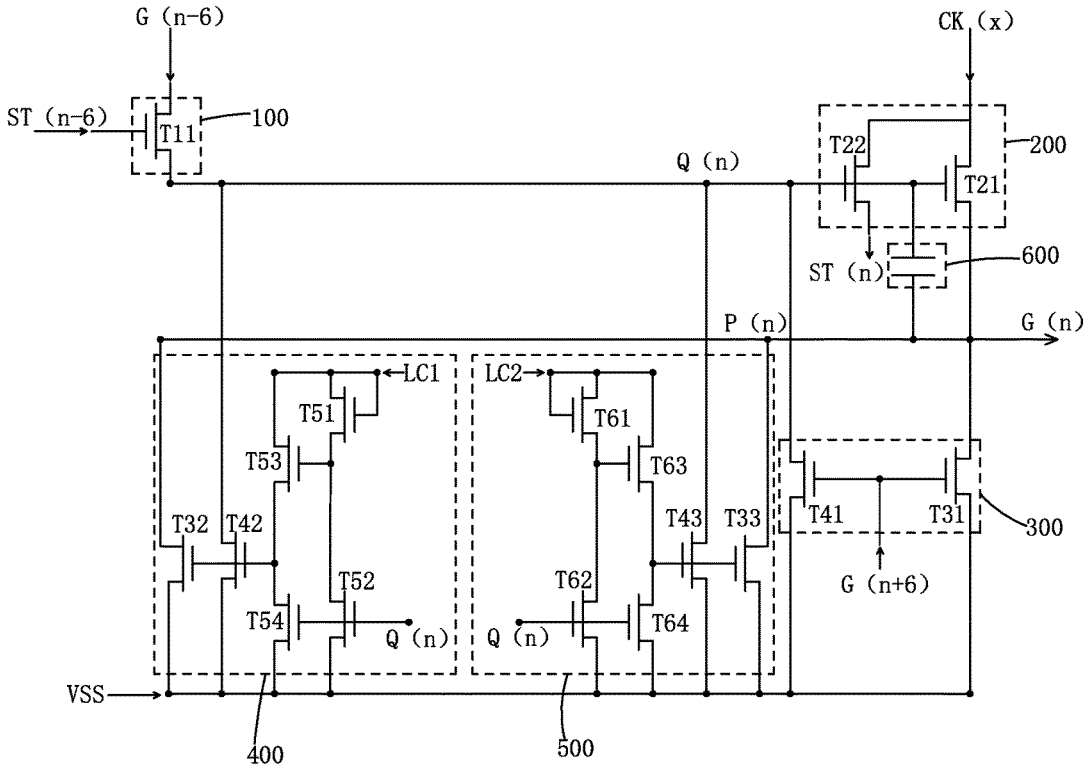
FIG. 1 is a schematic view showing a known circuit of the n-th GOA unit of the GOA driving circuit.

The pull-down module 3 only comprises a $41^{st}$ TFT T41, except the last GOA unit to the last m-th GOA unit, in the n-th GOA unit, the $41^{st}$ TFT T41 has a gate receiving a cascade-propagate signal G(n+m) outputted from (n+m)th GOA unit, a source electrically connected to the first node Q(n), a drain connected to a direct current (DC) low voltage VSS. In the last GOA unit to the last m-th GOA unit, the $41^{st}$ TFT T41 has a gate receiving the STV signal. Take m=6 as an example. In the last GOA unit to the last $6^{th}$ GOA unit, the $41^{st}$ TFT T41 has a gate receiving the STV signal. In the $1^{st}$ to the last $7^{th}$ GOA units, the $41^{st}$ TFT T41 has a gate receiving a cascade-propagate signal G(n+6) outputted from (n+6)th GOA unit. The pull-down module 3 only uses the $41^{st}$ TFT T41 to lower the voltage level of the first node Q(n) after the output of the scan driving signal G(n). Compared to the existing GOA circuits in FIG. 1, the $31^{st}$ TFT T31 for pulling down the voltage level of the scan driving signal G(n) and the second node P(n) is eliminated, and the task is completed by the $21^{st}$ TFT T21 in the pull-up module 2.

The first pull-down maintenance module 4 comprises: a $51^{st}$ TFT T51, a $52^{nd}$ TFT T52, a $53^{rd}$ TFT T53, a $32^{nd}$ TFT T32, and a $42^{nd}$ TFT T42; the $51^{st}$ TFT T51 has a gate and a source receiving a first low-frequency clock signal LC1, and a drain electrically connected to a third node S(n); the $53^{rd}$ TFT T53 has a gate electrically connected to the third node S(n), a source receiving the first low-frequency clock signal LC1, and a drain electrically connected to the third node S(n); the $52^{nd}$ TFT T52 has a gate electrically connected to the first node Q(n), a source connected to the third node S(n), and a drain receiving a DC low voltage VSS; the $32^{nd}$ TFT T32 has a gate electrically connected to the third node S(n), a source electrically connected to the second node P(n), and a drain receiving DC low voltage VSS; the $42^{nd}$ TFT T42 has a gate electrically connected to the third node S(n), a source electrically connected to the first node Q(n), and a drain receiving the DC low voltage VSS. When the first low-frequency clock signal LC1 is at high voltage and the first node Q(n) is at low voltage, the $51^{st}$ TFT T51 and the $53^{rd}$ TFT T53 are turned on and the $52^{nd}$ TFT T52 is cut-off. The high voltage of the first low-frequency clock signal LC1 reaches the third node S(n) and controls the $32^{nd}$ TFT T32 to turn on so that the second node P(n) continues to conduct the DC low voltage VSS. The $42^{nd}$ TFT T42 is turned on so that the first node Q(n) continues to conduct the DC low voltage VSS. Compared to the existing GOA circuit in FIG. 1, the first pull-down maintenance module 4 eliminates the $54^{th}$ TFT T54 on the basis of ensuring the pull-down maintenance function operating normally.

The second pull-down maintenance module 5 comprises: a $61^{st}$ TFT T61, a $62^{nd}$ TFT T62, a $63^{rd}$ TFT T63, a $33^{rd}$ TFT T33, and a $43^{rd}$ TFT T43; the $61^{st}$ TFT T61 has a gate and a source receiving a second low-frequency clock signal LC2, and a drain electrically connected to a fourth node K(n); the $63^{rd}$ TFT T63 has a gate electrically connected to the fourth node K(n), a source receiving the second low-frequency clock signal LC2, and a drain electrically connected to the fourth node K(n); the $62^{nd}$ TFT T62 has a gate electrically connected to the first node Q(n), a source connected to the fourth node K(n), and a drain receiving a DC low voltage VSS; the $33^{rd}$ TFT T33 has a gate electrically connected to the fourth node K(n), a source electrically connected to the second node P(n), and a drain receiving DC low voltage VSS; the $43^{rd}$ TFT T43 has a gate electrically connected to the fourth node K(n), a source electrically connected to the first node Q(n), and a drain receiving the DC low voltage Vss. When the second low-frequency clock signal LC2 is at high voltage and the first node Q(n) is at low voltage, the $61^{st}$ TFT T61 and the $63^{rd}$ TFT T63 are turned on and the $22^{nd}$ TFT T22 is cut-off. The high voltage of the second low-frequency clock signal LC2 reaches the fourth node K(n) and controls the $33^{rd}$ TFT T33 to turn on so that the second node P(n) continues to conduct the DC low voltage VSS. The $43^{rd}$ TFT T43 is turned on so that the first node Q(n) continues to conduct the DC low voltage VSS. Compared to the existing GOA circuit in FIG. 1, the second pull-down maintenance module 5 eliminates the $64^{th}$ TFT T64 on the basis of ensuring the pull-down maintenance function operating normally.

The bootstrap capacitor 6 has two electrode plates electrically connected to the first node Q(n) and the second node P(n) respectively. The bootstrap capacitor 6 is for pulling the voltage level of the first node Q(n) when scan driving signal G(n) outputted by the $21^{st}$ TFT T21 is at high voltage.

Furthermore, as shown in FIG. 3, the first low-frequency clock signal and the second low-frequency clocks signal have opposite phase, to control the first pull-down maintenance module 4 and the second pull-down maintenance module 5 operating alternatingly to maintain the voltage level of the scan driving signal G(n), the second node P(n), and the first node Q(n) at low voltage after pulled down. The high-frequency clock signal set comprises 12 high-frequency clock signals; with every 12 GOA units as a repetition unit, the 12 GOA units of a repetition unit receive the first to $12^{th}$ high-frequency clock signal CK(1)-CK(12) sequentially. The STV signal has a rising edge generated prior to the rising edge of the first high-frequency clock signal CK(1), and the STV signal has a falling edge generated simultaneously with falling edge of the first high-frequency clock signal CK(1).

The operation of the n-th GOA unit of the GOA driving circuit of the present invention is described as follows:

First phase: the cascade-propagate signal ST(n−6) and the scan driving signal G(n−6) outputted by the (n−6)th GOA unit are both at high voltage, the $11^{th}$ TFT T11 is turned on (the $11^{th}$ TFT T11 of the $1^{st}$ to $6^{th}$ GOA units are all turned on under the control of the SRV signal, to charge the bootstrap capacitor 6. The first node Q(n) is at high voltage to control the $21^{st}$ TFT T21 and $22^{nd}$ TFT T22 to turn on, the $52^{nd}$ TFT T52 and the $62^{nd}$ TFT T62 are turned on, the DC low voltage VSS reaches the third node S(n) and the fourth node K(n). The $32^{nd}$ TFT T32, the $42^{nd}$ TFT T42, the $33^{rd}$ TFT T33 and the $43^{nd}$ TFT T43 are all cut-off.

Second phase: the x-th high-frequency clock signal CK(x) provides high voltage, the $21^{st}$ TFT T21 outputs high voltage scan driving signal G(n), the $22^{nd}$ TFT T22 outputs the high voltage cascade-propagate signal ST(n), the bootstrap capacitor 6 raises the first node Q(n) even higher voltage level, the second node P(n) is at high voltage, the $32^{nd}$ TFT T32, the $42^{nd}$ TFT T42, the $33^{rd}$ TFT T33 and the $43^{rd}$ TFT T43 are all still cut-off.

Third phase: the x-th high-frequency clock signal CK(x) becomes low voltage, the scan driving signal G(n) outputted from the $21^{st}$ TFT T21 is pulled to low voltage; the high voltage scan driving signal G(n+6) outputted by the (n+6)th GOA unit arrives to control the $41^{st}$ TFT T41 to turn on (the last to the last $6^{th}$ GOA units control the turn-on of the $41^{st}$ TFT T41 through STV signal) so that the first node Q n) conducts the DC low voltage VSS, and pull down the voltage level of the first node Q(n).

Fourth Phase: the $52^{nd}$ TFT T52 and the $62^{nd}$ TFT T62 are cut off by the low voltage of the first node Q(n), the first low-frequency clock signal LC1 and the second low-frequency clock signal LC2 provide high voltage alternatingly. Correspondingly, the first pull-down maintenance module 4 and the second pull-down maintenance module 5 operate alternatingly so maintain the voltage level of the scan driving signal G(n), the second node P(n), and the first node Q(n) at low voltage after pulled down.

As shown in FIG. 4, GOA driving circuit outputs, in a stage-by-stage manner, scan driving signals G(1), G(2), G(3), G(4), G(5), G(6), G(7), and G(8). The operation is normal and stable. Compared to the prior art, the pull-down module 3 uses one less TFT, the first pull-down maintenance module 4 uses one less TFT and the second pull-down maintenance module 5 uses one less TFT. The GOA driving circuit of the present invention reduces the number of TFTs, saves the wiring area of the GOA driving circuit and enables narrow border LCD.

Based on the same design, the present invention also provides an LCD, comprising the above GOA driving circuit. Hence, the GOA driving circuit of the present invention reduces the number of TFTs, saves the wiring area of the GOA driving circuit and enables narrow border LCD. The details will not be repeated here.

In summary, the invention provides a GOA driving circuit, comprising: a plurality of GOA units connected in cascade, each GOA unit comprising a pull-up control module, a pull-up module, a pull-down module, a first pull-down maintenance module, and a second pull-down maintenance module; on the basis of ensuring the normal function of the GOA unit, the pull-down module uses one less TFT than the prior art, the first pull-down maintenance module uses one less TFT than the prior art, the second pull-down maintenance module uses one less TFT than the prior art, thereby saving the wiring area used by GOA driving circuit and facilitating the narrow border LCD. The invention provides an LCD using the GOA driving circuit. Therefore, the number of the TFTs of the GOA driving circuit is less, the wiring area is smaller, and the LCD border is narrower.

It should be noted that in the present disclosure the terms, such as, first, second are only for distinguishing an entity or operation from another entity or operation, and does not imply any specific relation or order between the entities or operations. Also, the terms "comprises", "include", and other similar variations, do not exclude the inclusion of other non-listed elements. Without further restrictions, the expression "comprises a . . . " does not exclude other identical elements from presence besides the listed elements.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the clams of the present invention.

What is claimed is:

1. A gate-driver-on-array (GOA) driving circuit, which comprises: a plurality of cascade GOA units, with each GOA unit comprising a pull-up control module, a pull-up module, a pull-down module, a first pull-down maintenance module, and a second pull-down maintenance module;

for integers n and x, in the n-th GOA unit:

the pull-up control module being electrically connected to a first node, for controlling the pull-up module to turn on;

the pull-up module being electrically connected to the first node and a second node, for receiving a x-th high-frequency clock signal in a high-frequency clock signal set, and outputting high voltage of the x-th high-frequency clock signal to corresponding scan line as a scan driving signal, outputting a cascade-propagate signal, and pulling down voltage levels of the scan driving signal and the second node after the scan driving signal outputting high voltage;

the pull-down module only comprising a $41^{st}$ thin film transistor (TFT), the $41^{st}$ TFT having a source electrically connected to the first node, a drain connected to a direct current (DC) low voltage, for pulling down voltage level of the first node after the scan driving signal outputting;

the first pull-down maintenance module comprising: a $51^{st}$ TFT, a $52^{nd}$ TFT, a $53^{rd}$ TFT, a $32^{nd}$ TFT, and a $42^{nd}$ TFT; the $51^{st}$ TFT having a gate and a source receiving a first low-frequency clock signal, and a drain electrically connected to a third node; the $53^{rd}$ TFT having a gate electrically connected to the third node, a source receiving the first low-frequency clock signal, and a drain electrically connected to the third node; the $52^{nd}$ TFT having a gate electrically connected to the first node, a source connected to the third node, and a drain receiving a DC low voltage; the $32^{nd}$ TFT having a gate electrically connected to the third node, a source electrically connected to the second node, and a drain receiving DC low voltage; the $42^{nd}$ TFT having a gate electrically connected to the third node, a source electrically connected to the first node, and a drain receiving the DC low voltage;

the second pull-down maintenance module comprising: a $61^{st}$ TFT, a $62^{nd}$ TFT, a $63^{rd}$ TFT, a $33^{rd}$ TFT, and a $43^{rd}$ TFT; the $61^{st}$ TFT having a gate and a source receiving a second low-frequency clock signal, and a drain electrically connected to a fourth node; the $63^{rd}$ TFT having a gate electrically connected to the fourth node, a source receiving the second low-frequency clock signal, and a drain electrically connected to the fourth node; the $62^{nd}$ TFT having a gate electrically connected to the first node, a source connected to the fourth node, and a drain receiving a DC low voltage; the $33^{rd}$ TFT having a gate electrically connected to the fourth node, a source electrically connected to the second node, and a drain receiving DC low voltage; the $43^{rd}$ TFT having a gate electrically connected to the fourth node, a source electrically connected to the first node, and a drain receiving the DC low voltage;

the first pull-down maintenance module and the second pull-down maintenance module operating alternatingly to maintain the voltage level of the scan driving signal, the second node, and the first node at low voltage after pulled down.

2. The GOA driving circuit as claimed in claim 1, wherein the GOA driving circuit further comprises a bootstrap capacitor, with two electrode plates electrically connected to the first node and the second node respectively.

3. The GOA driving circuit as claimed in claim 1, wherein the pull-up control module comprises an $11^{th}$ TFT;

assuming m is an $_{integer}$ less than n, except the first GOA unit to the m-th GOA unit, in the n-th GOA unit, the $11^{th}$ TFT has a gate receiving a cascade-propagate signal outputted from (n−m)th GOA unit, a source receiving a scan driving signal outputted from (n−m)th GOA unit, and a drain electrically connected to the first node;

except the last GOA unit to the last m-th GOA unit, in the n-th GOA unit, the $41^{st}$ TFT has a gate receiving a cascade-propagate signal outputted from (n+m)th GOA unit.

4. The GOA driving circuit as claimed in claim 3, wherein in the first GOA unit to the m-th GOA unit, the 11th TFT has a gate receiving an STV signal and a source receiving the STV signal;

in the last GOA unit to the last m-th GOA unit, the $41^{st}$ TFT has a gate receiving the STV signal.

5. The GOA driving circuit as claimed in claim 4, wherein m is set to 6.

6. The GOA driving circuit as claimed in claim 5, wherein the high-frequency clock signal set comprises 12 high-frequency clock signals; with every 12 GOA units as a repetition unit, the 12 GOA units of a repetition unit receive the first to $12^{th}$ high-frequency clock signal sequentially.

7. The GOA driving circuit as claimed in claim 6, wherein the STV signal has a rising edge generated prior to the rising edge of the first high-frequency clock signal, and the STV signal has a falling edge generated simultaneously with falling edge of the first high-frequency clock signal.

8. The GOA driving circuit as claimed in claim 1, wherein the pull-up module comprises a $21^{st}$ TFT and a $22^{nd}$ TFT;

the $21^{st}$ TFT has a gate electrically connected to the first node, a source receiving an x-th high-frequency clock signal in a high-frequency clock signal set, and a drain electrically connected to the second node and outputting the scan driving signal of the n-th GOA unit;

the $22^{nd}$ TFT has a gate electrically connected to the first node, a source receiving an x-th high-frequency clock signal in a high-frequency clock signal set, and a drain outputting the cascade-propagate signal of the n-th GOA unit.

9. The GOA driving circuit as claimed in claim 1, wherein the first low-frequency clock signal and the second low-frequency clocks signal have opposite phase.

10. A liquid crystal display (LCD), comprising a GOA driving circuit as claimed in claim 1.

11. A gate-driver-on-array (GOA) driving circuit, which comprises: a plurality of cascade GOA units, with each GOA unit comprising a pull-up control module, a pull-up module, a pull-down module, a first pull-down maintenance module, and a second pull-down maintenance module;

for integers n and x, in the n-th GOA unit:

the pull-up control module being electrically connected to a first node, for controlling the pull-up module to turn on;

the pull-up module being electrically connected to the first node and a second node, for receiving a x-th high-frequency clock signal in a high-frequency clock signal set, and outputting high voltage of the x-th high-frequency clock signal to corresponding scan line as a scan driving signal, outputting a cascade-propagate signal, and pulling down voltage levels of the scan driving signal and the second node after the scan driving signal outputting high voltage;

the pull-down module only comprising a $41^{st}$ thin film transistor (TFT), the $41^{st}$ TFT having a source electrically connected to the first node, a drain connected to a direct current (DC) low voltage, for pulling down voltage level of the first node after the scan driving signal outputting;

the first pull-down maintenance module comprising: a $51^{st}$ TFT, a $52^{nd}$ TFT, a $53^{rd}$ TFT, a $32^{nd}$ TFT, and a $42^{nd}$ TFT; the $51^{st}$ TFT having a gate and a source receiving a first low-frequency clock signal, and a drain electrically connected to a third node; the $53^{rd}$ TFT having a gate electrically connected to the third node, a source receiving the first low-frequency clock signal, and a drain electrically connected to the third node; the $52^{nd}$ TFT having a gate electrically connected to the first node, a source connected to the third node, and a drain receiving a DC low voltage; the $32^{nd}$ TFT having a gate electrically connected to the third node, a source electrically connected to the second node, and a drain receiving DC low voltage; the $42^{nd}$ TFT having a gate electrically connected to the third node, a source electrically connected to the first node, and a drain receiving the DC low voltage;

the second pull-down maintenance module comprising: a $61^{st}$ TFT, a $62^{nd}$ TFT, a $63^{rd}$ TFT, a $33^{rd}$ TFT, and a $43^{rd}$ TFT; the $61^{st}$ TFT having a gate and a source receiving a second low-frequency clock signal, and a drain electrically connected to a fourth node; the $63^{rd}$ TFT having a gate electrically connected to the fourth node, a source receiving the second low-frequency clock signal, and a drain electrically connected to the fourth node; the $62^{nd}$ TFT having a gate electrically connected to the first node, a source connected to the fourth node, and a drain receiving a DC low voltage; the $33^{rd}$ TFT having a gate electrically connected to the fourth node, a source electrically connected to the second node, and a drain receiving DC low voltage; the $43^{rd}$ TFT having a gate electrically connected to the fourth node, a source electrically connected to the first node, and a drain receiving the DC low voltage;

the first pull-down maintenance module and the second pull-down maintenance module operating alternatingly to maintain the voltage level of the scan driving signal, the second node, and the first node at low voltage after pulled down;

further comprising a bootstrap capacitor, with two electrode plates electrically connected to the first node and the second node respectively;

wherein the pull-up control module comprising an $11^{th}$ TFT;

assuming m being an integer less than n, except the first GOA unit to the m-th GOA unit, in the n-th GOA unit, the $11^{th}$ TFT having a gate receiving a cascade-propagate signal outputted from (n−m)th GOA unit, a source receiving a scan driving signal outputted from (n−m)th GOA unit, and a drain electrically connected to the first node;

except the last GOA unit to the last m-th GOA unit, in the n-th GOA unit, the $41^{st}$ TFT having a gate receiving a cascade-propagate signal outputted from (n+m)th GOA unit;

wherein the pull-up module comprising a $21^{st}$ TFT and a $22^{nd}$ TFT;

the $21^{st}$ TFT having a gate electrically connected to the first node, a source receiving an x-th high-frequency clock signal in a high-frequency clock signal set, and a drain electrically connected to the second node and outputting the scan driving signal of the n-th GOA unit;

the $22^{nd}$ TFT having a gate electrically connected to the first node, a source receiving an x-th high-frequency clock signal in a high-frequency clock signal set, and a drain outputting the cascade-propagate signal of the n-th GOA unit;

wherein in the first GOA unit to the m-th GOA unit, the 11th TFT having a gate receiving an STV signal and a source receiving the STV signal;

in the last GOA unit to the last m-th GOA unit, the $41^{st}$ TFT having a gate receiving the STV signal.

12. The GOA driving circuit as claimed in claim 11, wherein m is set to 6.

13. The GOA driving circuit as claimed in claim 12, wherein the high-frequency clock signal set comprises 12 high-frequency clock signals; with every 12 GOA units as a repetition unit, the 12 GOA units of a repetition unit receive the first to $12^{th}$ high-frequency clock signal sequentially.

14. The GOA driving circuit as claimed in claim 13, wherein the STV signal has a rising edge generated prior to the rising edge of the first high-frequency clock signal, and the SW signal has a falling edge generated simultaneously with falling edge of the first high-frequency clock signal.

15. The GOA driving circuit as claimed in claim 11, wherein the first low-frequency clock signal and the second low-frequency clocks signal have opposite phase.

* * * * *